US008575905B2

(12) United States Patent
Bulzacchelli et al.

(10) Patent No.: US 8,575,905 B2
(45) Date of Patent: Nov. 5, 2013

(54) DUAL LOOP VOLTAGE REGULATOR WITH BIAS VOLTAGE CAPACITOR

(75) Inventors: John Bulzacchelli, Yonkers, NY (US); Paul D. Muench, Poughkeepsie, NY (US); Michael A. Sperling, Poughkeepsie, NY (US); Zeynep Toprak-Deniz, Norwalk, CT (US)

(73) Assignee: International Business Machines Corporation, Armonk, NY (US)

( * ) Notice: Subject to any disclaimer, the term of this patent is extended or adjusted under 35 U.S.C. 154(b) by 353 days.

(21) Appl. No.: 12/822,507

(22) Filed: Jun. 24, 2010

(65) Prior Publication Data

US 2011/0316506 A1 Dec. 29, 2011

(51) Int. Cl.
*G05F 1/40* (2006.01)
*G05F 1/44* (2006.01)

(52) U.S. Cl.
USPC ..... 323/274; 323/273; 323/280; 323/281; 323/284

(58) Field of Classification Search
USPC ..... 323/273, 274, 280, 281, 284
See application file for complete search history.

(56) References Cited

U.S. PATENT DOCUMENTS

| | | | | |
|---|---|---|---|---|
| 5,631,598 | A * | 5/1997 | Miranda et al. | 327/540 |
| 5,686,821 | A * | 11/1997 | Brokaw | 323/273 |
| 5,966,004 | A * | 10/1999 | Kadanka | 323/271 |
| 6,188,212 | B1 * | 2/2001 | Larson et al. | 323/281 |
| 6,246,221 | B1 * | 6/2001 | Xi | 323/280 |
| 6,518,737 | B1 * | 2/2003 | Stanescu et al. | 323/280 |
| 6,653,891 | B1 | 11/2003 | Hazucha | |
| 6,856,124 | B2 * | 2/2005 | Dearn et al. | 323/280 |
| 7,151,363 | B1 | 12/2006 | Scott et al. | |
| 7,265,607 | B1 | 9/2007 | Rajapandian et al. | |
| 7,268,524 | B2 | 9/2007 | Kase et al. | |
| 7,402,987 | B2 * | 7/2008 | Lopata | 323/282 |
| 7,952,337 | B2 * | 5/2011 | Gurcan | 323/282 |
| 8,022,681 | B2 * | 9/2011 | Gurcan | 323/283 |
| 2008/0174289 | A1 | 7/2008 | Gurcan et al. | |
| 2009/0059627 | A1 * | 3/2009 | Kim | 363/40 |
| 2010/0090667 | A1 | 4/2010 | Gleason et al. | |

* cited by examiner

*Primary Examiner* — Bao Q Vu
(74) *Attorney, Agent, or Firm* — Cantor Colburn LLP; William A. Kinnaman, Jr.

(57) ABSTRACT

A voltage regulator includes a regulator input connected to a reference voltage; a regulator output that outputs a regulated voltage to an electrical load; a first loop, the first loop configured to receive the reference voltage, the first loop outputting a bias voltage; a second loop, the second loop configured to receive the bias voltage as an input; and a bias voltage capacitor connected to a node between the first loop and the second loop.

20 Claims, 2 Drawing Sheets

DUAL LOOP VOLTAGE REGULATOR WITH BIAS VOLTAGE CAPACITOR

BACKGROUND

This invention relates generally to power management within a computing environment, and more particularly to on-chip voltage regulation.

In many electrical systems, it is desirable to maintain stability of the electrical system regardless of the load impedance applied to the circuitry. For example, sensitive circuitry in a computer system may require a voltage level having high direct current (DC) accuracy and low alternating current (AC) noise for good operation. However, if the circuitry comprises a variable load, the changes in the load may cause an electrical system to become unstable. An on-chip voltage regulator connected between the circuitry and an external power supply (or reference voltage) may be used to create the desired voltage level on the chip local to the circuitry based on the reference voltage. The output of the voltage regulator associated with an electrical system, therefore, should be able to remain stable even when the impedance of the load attached to the voltage regulator varies over time.

An on-chip voltage regulator may comprise a linear voltage regulator. A linear regulator may include a gain path, or loop, with an output of an error amplifier connected to a gate of an output device that acts like a variable resistor. However, a linear regulator may have a slow response to changes in the output loading, since the feedback voltage may have to go all the way back through the error amplifier to affect the gate voltage of the output device.

BRIEF SUMMARY

An embodiment is a voltage regulator including a regulator input connected to a reference voltage; a regulator output that outputs a regulated voltage to an electrical load; a first loop, the first loop configured to receive the reference voltage, the first loop outputting a bias voltage; a second loop, the second loop configured to receive the bias voltage as an input; and a bias voltage capacitor connected to a node between the first loop and the second loop.

Another embodiment is a method of voltage regulation including receiving a reference voltage by a first loop of a voltage regulator, outputting a bias voltage by the first loop to a bias voltage capacitor; receiving the bias voltage by a second loop of the voltage regulator from the bias voltage capacitor; and outputting a regulated voltage by the voltage regulator to an electrical load.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE SEVERAL VIEWS OF THE DRAWINGS

Referring now to the drawings wherein like elements are numbered alike in the several FIGURES.

DETAILED DESCRIPTION

An exemplary embodiment of the present invention provides a dual loop voltage regulator, comprising a first slower loop and a second faster loop, with a bias voltage capacitor located in between the slow loop and the fast loop. The second loop may improve the functioning of a linear regulator by allowing response to output load changes relatively quickly. However, an on-chip voltage regulator having two loops may have stability problems. Stability concerns are alleviated by applying the external reference voltage to the slow loop, and locating a bias voltage capacitor at a node between the slow and fast loops. A feedback path from the regulator output into both the first and second loops allows relatively fast detection of and response to changes in the output load. The DC error of the voltage regulator is low because of the high gain and low bandwidth of the slower first loop, while the AC response is dominated by the faster second loop, which has a lower gain and higher bandwidth as compared to the slow loop. The bias voltage capacitor holds the state of the slow loop, and provides the state of the slow loop to the fast loop for comparison with the output feedback. Therefore, the regulator not only has good DC accuracy due to the high DC gain, but it will also have relatively fast performance with few output voltage limitations.

Figure 1:
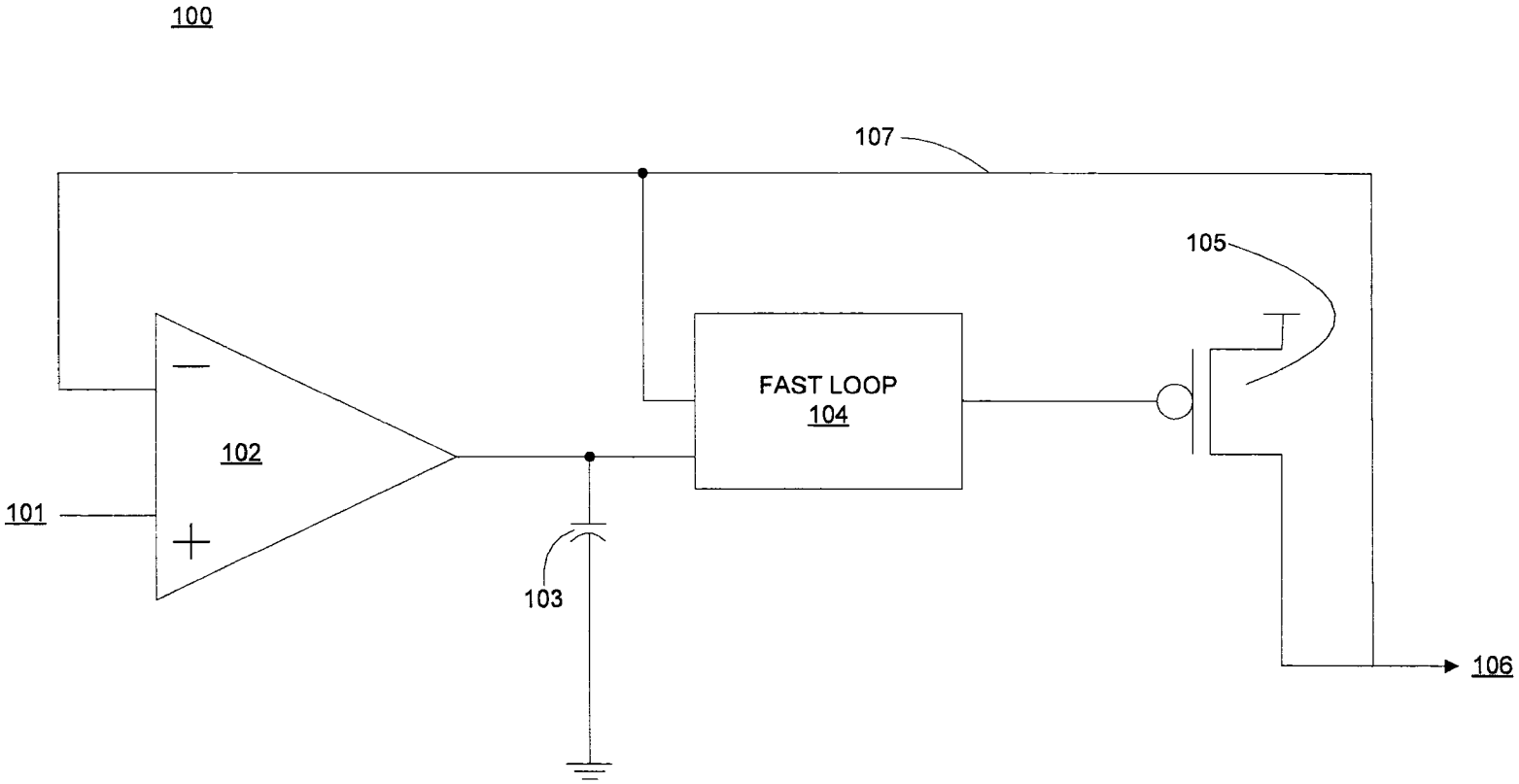
FIG. 1 depicts an embodiment of a dual loop voltage regulator with a bias voltage capacitor.

FIG. 1 illustrates an embodiment of a dual loop voltage regulator 100 with a bias voltage capacitor 103. Dual loop voltage regulator 100 acts to maintain a regulated output voltage ($V_{reg}$) as close as possible to a reference voltage ($V_{ref}$) received from an external power supply independent of loading changes in an output load (not shown) connected to output 106. $V_{ref}$ is input to dual loop voltage regulator 100 at input 101, and $V_{reg}$ is output at output 106. $V_{reg}$ is looped back into an input of the slow loop 102 (which comprises an error, or differential, amplifier in the embodiment shown in FIG. 1), and into an input of fast loop 104 via a feedback loop 107. Slow loop 102 may have a high gain and low input offset. Slow loop 102 outputs the difference between $V_{ref}$ and $V_{reg}$ as a bias voltage ($V_{bias}$), which is stored in bias voltage capacitor 103. Bias voltage capacitor 103 ensures that $V_{bias}$ changes relatively slowly, responding to changes in temperature and long-term output loading. A good power supply rejection ratio (PSSR) may be obtained by connecting the bottom of bias voltage capacitor 103 to ground, as shown in FIG. 1, or to $V_{reg}$, depending on the system requirements for $V_{reg}$. If dual loop voltage regulator 100 is used in a ground-referenced system, the bottom of bias voltage capacitor 103 may be connected to ground as shown in FIG. 1; however, if dual loop voltage regulator 100 is used in a supply referenced system, the bottom of bias voltage capacitor 103 may be connected to the power supply. $V_{bias}$ is input to fast loop 104 from bias voltage capacitor 103. Fast loop 104 may comprise an amplifier having a relatively low gain and high bandwidth, and respond to changes in the output load relatively quickly. The output of fast loop 104 is input as a gate voltage to output p-type field effect transistor (PFET) 105. Output PFET 105 outputs $V_{reg}$ to the load connected to output 106 and feedback loop 107 at the PFET drain. While the embodiment of FIG. 1 shows an output PFET 105, some embodiments of a dual loop voltage regulator may comprise an output n-type field effect transistor (NFET) in place of output PFET 105.

Figure 2:
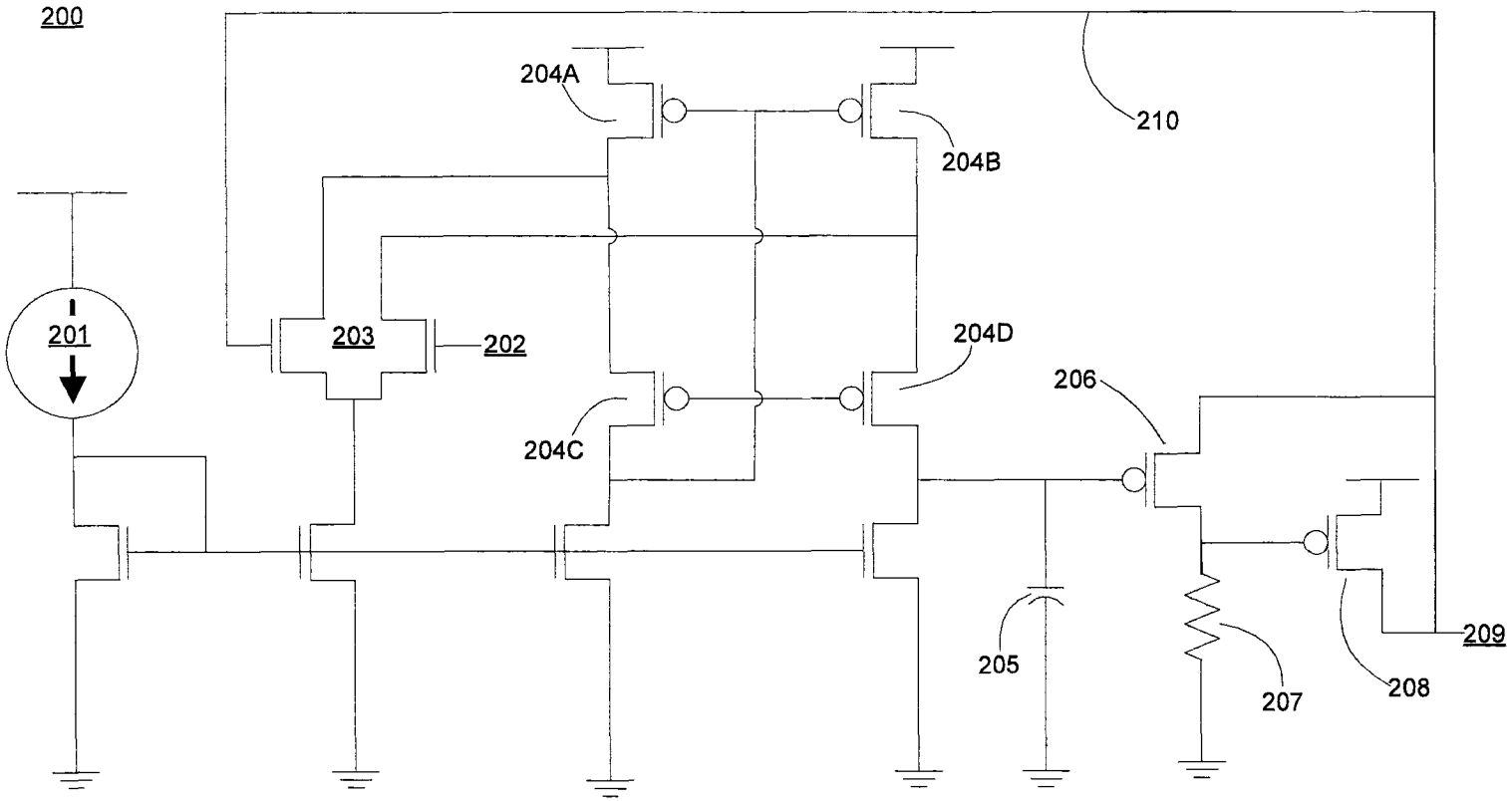
FIG. 2 depicts another embodiment of a dual loop voltage regulator with a bias voltage capacitor.

FIG. 2 illustrates another embodiment of a dual loop voltage regulator 200 with a bias voltage capacitor 205. FIG. 2 is discussed with reference to FIG. 1. Current source 201 powers dual loop voltage regulator 200. Slow loop 102 is implemented as a folded cascode amplifier, comprising n-type FETs (NFETs) 203 and PFETs 204A-D. $V_{ref}$ is input from an external power source (not shown) as a gate voltage to a first NFET of NFETs 203 at input 202. $V_{reg}$ is input as a gate voltage to a second NFET of NFETs 203 from feedback loop 210. The node between the gates of PFET 204C and PFET

204D comprises a PFET cascode bias voltage. The folded cascode amplifier comprising NFETs 203 and PFETs 204A-D outputs $V_{bias}$, which is a difference between $V_{ref}$ and $V_{reg}$, to bias voltage capacitor 205. Bias voltage capacitor 205 stores and prevents fluctuations in $V_{bias}$. Fast loop 104 is implemented as a common gate amplifier comprising PFET 206 and resistor 207. $V_{bias}$ is input to the gate of fast loop PFET 206 from bias voltage capacitor 205. $V_{reg}$ is input to the source of PFET 206 from feedback loop 210. PFET 206 passes current at its drain, creating a voltage at the top of the resistor 207 that is input as a gate voltage to output PFET 208. Output PFET 208 is equivalent to output PFET 105 of FIG. 1. Output PFET 208 outputs $V_{reg}$ at its drain to an output load (not shown) connected to regulator output 209, and to feedback loop 210.

$V_{bias}$ will not change quickly due to the stabilizing effect of bias voltage capacitor 205. So, a high speed drop in $V_{reg}$ (due to, for example, a change in the output load) will cause PFET 206 to decrease its through current, causing the gate voltage of output PFET 208 to decrease. This turns the output PFET 208 on stronger, correcting the drop in voltage in $V_{reg}$. Conversely, a sudden increase in $V_{reg}$ will cause PFET 206 to send more current through resistor 207, increasing the gate voltage of output PFET 208 and shutting off the output PFET 208, thereby allowing the output load to drag $V_{reg}$ down. In the dual loop voltage regulator 200 as shown in FIG. 2, the gate voltage of output PFET 208 is limited to going as high as $V_{reg}$ minus the saturation voltage of PFET 206; however, this limitation may be overcome by adding another gain stage to the fast loop, thereby decoupling that relationship. While the embodiment of FIG. 2 shows an output PFET 208, some embodiments of a dual loop voltage regulator may comprise an output n-type field effect transistor (NFET) in place of output PFET 208.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The invention claimed is:

1. A voltage regulator comprising:

a regulator input connected to a reference voltage;

a regulator output that outputs a regulated voltage to an electrical load;

a first loop, the first loop configured to receive the reference voltage at a first input and the regulated voltage at a second input, the first loop outputting a bias voltage at an output of the first loop;

a second loop, the second loop configured to receive the bias voltage at a third input;

a bias voltage capacitor connected to a node located between the output of the first loop and the third input of the second loop; and a feedback loop comprising a connection between the regulator output and the second input of the first loop that provides the regulated voltage from the regulator output to the second input of the first loop.

2. The voltage regulator of claim 1, wherein the bias voltage capacitor is configured to hold a state of the bias voltage.

3. The voltage regulator of claim 1, wherein the first loop has a first loop gain and a first loop bandwidth, wherein the second loop has a second loop gain and a second loop bandwidth, and wherein the first loop gain is higher than the second loop gain and the first loop bandwidth is lower than the second loop bandwidth.

4. The voltage regulator of claim 1, wherein the feedback loop from the regulator output further comprises a connection between the regulator output and a fourth input of the second loop that provides the regulated voltage from the regulator output to the fourth input of the second loop.

5. The voltage regulator of claim 1, wherein the bias voltage comprises a difference between the reference voltage and regulated voltage.

6. The voltage regulator of claim 1, wherein the first loop comprises an error amplifier.

7. The voltage regulator of claim 6, wherein the first loop comprises a folded cascode amplifier.

8. The voltage regulator of claim 7, wherein the folded cascode amplifier that comprises the first loop comprises a plurality of n-type field effect transistors (NFETs) connected with a plurality of p-type field effect transistors (PFETs).

9. The voltage regulator of claim 1, wherein the second loop comprises a common gate amplifier.

10. The voltage regulator of claim 9, wherein the common gate amplifier that comprises the second loop comprises a PFET and a resistor connected to the drain of the PFET.

11. The voltage regulator of claim 10, wherein the PFET of the common gate amplifier receives the bias voltage as a gate voltage and receives the regulated voltage as a source voltage.

12. The voltage regulator of claim 1, further comprising an output FET located between an output of the second loop and the regulator output.

13. The voltage regulator of claim 12, wherein the output FET comprises an NFET.

14. The voltage regulator of claim 12, wherein the output FET comprises a PFET, and wherein the output PFET receives an output of the second loop as a gate voltage and outputs the regulated voltage to the regulator output and to the feedback loop at a drain of the output PFET.

15. The voltage regulator of claim 9, wherein the second loop further comprises a gain stage.

16. The voltage regulator of claim 1, wherein a first end of the bias voltage capacitor is connected to a node located between the first loop and the second loop, and a second end of the bias voltage capacitor is connected to ground.

17. The voltage regulator of claim 1, wherein the voltage regulator is part of a supply referenced system, wherein a first end of the bias voltage capacitor is connected to a node located between the first loop and the second loop, and a second end of the bias voltage capacitor is connected to a power supply.

18. A method of voltage regulation, comprising:

receiving a reference voltage at a first input of a first loop of a voltage regulator and a regulated voltage at a second input of the first loop by the first loop of the voltage regulator, outputting a bias voltage by the first loop to a bias voltage capacitor;

receiving the bias voltage by a second loop of the voltage regulator from the bias voltage capacitor;

outputting the regulated voltage by a regulator output of the voltage regulator to an electrical load; and providing, via a feedback loop comprising a connection between the regulator output and the second input of the first loop, the regulated voltage from the regulator output to the second input of the first loop.

19. The method of claim 18, further comprising holding a state of the bias voltage by the bias capacitor.

20. The method of claim 18, wherein the first loop has a first loop gain and a first loop bandwidth, wherein the second loop has a second loop gain and a second loop bandwidth, and wherein the first loop gain is higher than the second loop gain and the first loop bandwidth is lower than the second loop bandwidth.

* * * * *